US007004557B2

(12) United States Patent
Inoue

(10) Patent No.: US 7,004,557 B2
(45) Date of Patent: Feb. 28, 2006

(54) LIQUID EJECTING DEVICE

(75) Inventor: Hiroshi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 50 days.

(21) Appl. No.: 10/628,401

(22) Filed: Jul. 29, 2003

(65) Prior Publication Data

US 2004/0070641 A1 Apr. 15, 2004

(30) Foreign Application Priority Data

Jul. 29, 2002 (JP) ..... 2002-220018

(51) Int. Cl.
*B41J 29/393* (2006.01)

(52) U.S. Cl. ..... 347/19

(58) Field of Classification Search ..... 347/6, 347/7, 14, 19, 85; 222/61
See application file for complete search history.

(56) References Cited

U.S. PATENT DOCUMENTS

| | | | | |
|---|---|---|---|---|
| 3,787,882 | A * | 1/1974 | Fillmore et al. | 347/6 |
| 4,651,161 | A * | 3/1987 | Rich et al. | 347/6 |
| 5,812,156 | A * | 9/1998 | Bullock et al. | 347/19 |
| 5,969,736 | A * | 10/1999 | Field et al. | 347/85 |
| 6,220,700 | B1 | 4/2001 | Haigo | |
| 6,454,375 | B1 * | 9/2002 | Wilson et al. | 347/7 |

* cited by examiner

*Primary Examiner*—Thinh Nguyen
(74) *Attorney, Agent, or Firm*—Sughrue Mion, PLLC

(57) ABSTRACT

An ink jet printer has an ink jet printhead, which includes an ink chamber for containing ink. An array of plural ejection nozzles eject the ink from the ink chamber at an ejecting amount controlled individually from one another. A pressure sensor measures atmospheric pressure and inner pressure of the ink chamber. A system controller sets a pressure difference between the atmospheric pressure and the inner pressure at a predetermined value by adjustment. In one preferred embodiment, the predetermined value is a reference value for regularizing the ejecting amount.

22 Claims, 7 Drawing Sheets

LIQUID EJECTING DEVICE

BACKGROUND OF THE INVENTION

1. Field of the Invention

The present invention relates to a liquid ejecting device. More particularly, the present invention relates to a liquid ejecting device in which liquid droplets can be ejected in a regularly optimized amount or size.

2. Description Related to the Prior Art

An ink jet printer is known as an image forming device in which liquid is ejected. An ink jet printhead has an array of ejection nozzles for ejecting ink to recording material. An ink supply tank is incorporated the ink jet printer, and supplies the ink jet printhead with ink through an ink supply tube or supply path.

One type of the ink jet printer has the ink jet printhead movable up and down in the course of printing. In this type, water head pressure of the ink applied to the ejection nozzles is remarkably changed by the vertical movement of the ink jet printhead. A size in ink droplets ejected by the ejection nozzles changes to lower the image quality. In order to solve such a problem, a type of the ink jet printer disclosed in U.S. Pat. No. 6,220,700 (corresponding to JP-A 11-277768) has a pressure adjustor for adjusting the water head pressure of the ink according to a position of the ink jet printhead.

The water head pressure in the ink jet printer applied to the ejection nozzles changes also according to specific types of the ink. So known types of the ink jet printer has a short coming of degradation of image due to changes in the size of ink droplets ejected through the ejection nozzles. Failure may occur in ejection of ink. Furthermore, the supply tank may be refilled with ink in the course of recording one image, because the water head pressure change to lower the quality of the image. A more serious problem may occur in that there is a leakage of the ink to pollute the recording material.

It is necessary to control the water head pressure applied to the ejection nozzles according to types of the ink. However, the above-indicated prior document does not suggest countermeasures to changes in the water head pressure in consideration of the types of the ink or refilling of the ink. In the document, only the ink jet printer with the ink jet printhead movable vertically is disclosed. There is no known technique of keeping image quality by effectively considering changes in the water head pressure.

Also, the water head pressure of the ink is influenced by atmospheric pressure. To control the water head pressure with high precision, it is necessary to consider the total of the influence of the type of the ink, the atmospheric pressure and other important factors.

SUMMARY OF THE INVENTION

In view of the foregoing problems, an object of the present invention is to provide a liquid ejecting device in which liquid droplets can be ejected in a regularly optimized amount or size.

In order to achieve the above and other objects and advantages of this invention, a liquid ejecting device comprises a liquid ejecting head, including an array of plural ejection nozzles for ejecting liquid at an ejecting amount controlled individually from one another. At least one pressure sensor measures atmospheric pressure and inner pressure of the liquid ejecting head. A controller sets a pressure difference between the atmospheric pressure and the inner pressure at a predetermined value by adjustment.

Specifically, the predetermined value is a reference value for regularizing the ejecting amount.

In one preferred embodiment, a controller evaluates a pressure difference between the atmospheric pressure and the inner pressure by comparison with reference value, and adjusts the ejecting amount according thereto.

If the pressure difference is higher than the reference value, the controller decreases the ejecting amount.

Furthermore, a supply tank is loaded with the liquid, for supplying the liquid ejecting head with the liquid. A characteristic information detector detects characteristic information of the liquid. The controller determines the reference value according to the characteristic information.

The pressure sensor is disposed on the liquid ejecting head, or a liquid supply path for connection between the liquid ejecting, head and the supply tank.

Furthermore, a subsidiary tank is connected between the supply tank and the liquid ejecting head, for storing the liquid in a temporary manner. An air release valve openably closes a path between an inside of the subsidiary tank and an outside thereof. The pressure sensor is disposed in the subsidiary tank, and when the air release valve is open, detects the atmospheric pressure, and when the air release valve is closed, detects the inner pressure.

Furthermore, a pumping height adjustor shifts up or down one of the liquid ejecting head and the supply tank relative to a remaining one thereof, wherein if the pressure difference is higher than the reference value, the pumping height adjustor is controlled by the controller, to increase a pumping height so as to decrease the ejecting amount, where the pumping height is a difference obtained by subtracting a height level of the liquid surface of the liquid in the supply tank from a height level of the nozzle arrangement surface of the plural ejection nozzles.

Furthermore, a liquid level sensor is disposed in the supply tank, for detecting a position of the liquid surface. The pumping height adjustor obtains the height level of the liquid surface according to the position thereof, and moves the supply tank.

When supply of the liquid from the supply tank is initially started, the pumping height adjustor sets the liquid surface higher than the nozzle arrangement surface, to promote supply to the liquid ejecting head.

The pumping height adjustor includes an eccentric cam mechanism for pressing a lower surface of the supply tank. An actuator drives the eccentric cam mechanism to move the supply tank up and down. At least one rail guides the supply tank up and down by preventing the supply tank from offsetting horizontally.

Furthermore, a pressure adjustor is controlled by the controller if the pressure difference is higher than the reference value, for decreasing a liquid pressure for supply of the liquid from the supply tank, so as to decrease the ejecting amount.

At least one portion of the supply tank is constituted by a flexible panel. The pressure adjustor further includes a flexible air container secured to an outside of the flexible panel. An air pump exhausts air from the air container, to decrease the liquid pressure in the supply tank through the flexible panel.

Furthermore, an inlet port is formed through the supply tank, settable between open and closed states, adapted for replenishment of the liquid when set in the open state, wherein the atmospheric pressure is applied to the liquid surface through the inlet port.

Furthermore, a nozzle cap mechanism is movable to and away from the liquid ejecting head, actuated while the pressure sensor measures the atmospheric pressure, for covering the ejection nozzles, to prevent the liquid from leakage.

While the nozzle cap mechanism is away from the ejection nozzles, the pressure sensor measures the inner pressure.

The supply tank is loaded with a liquid cartridge for containing the liquid. The characteristic information is disposed on a surface of the liquid cartridge, and read by the characteristic information detector.

The characteristic information detector reads the characteristic information in response to loading of the liquid cartridge.

The controller determines an initial level of the ejecting amount in response to loading of the liquid cartridge.

The pressure sensor measures the inner pressure and the atmospheric pressure in response to loading of the liquid cartridge.

The pressure sensor measures the inner pressure and the atmospheric pressure each time upon lapse of a predetermined time.

If the inner pressure measured by the pressure sensor changes during determination of the ejecting amount in the controller, the controller generates an alarm signal.

The pressure sensor measures the inner pressure each time that the liquid ejecting head ejects the liquid at a predetermined amount.

The characteristic information is information of at least one of viscosity, surface tension, density and producing date of the liquid.

The liquid is one of at least first and second types, and the characteristic information represents the first or second type.

A nozzle arrangement surface of the plural ejection nozzles is directed downwards, and kept oriented substantially horizontally.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
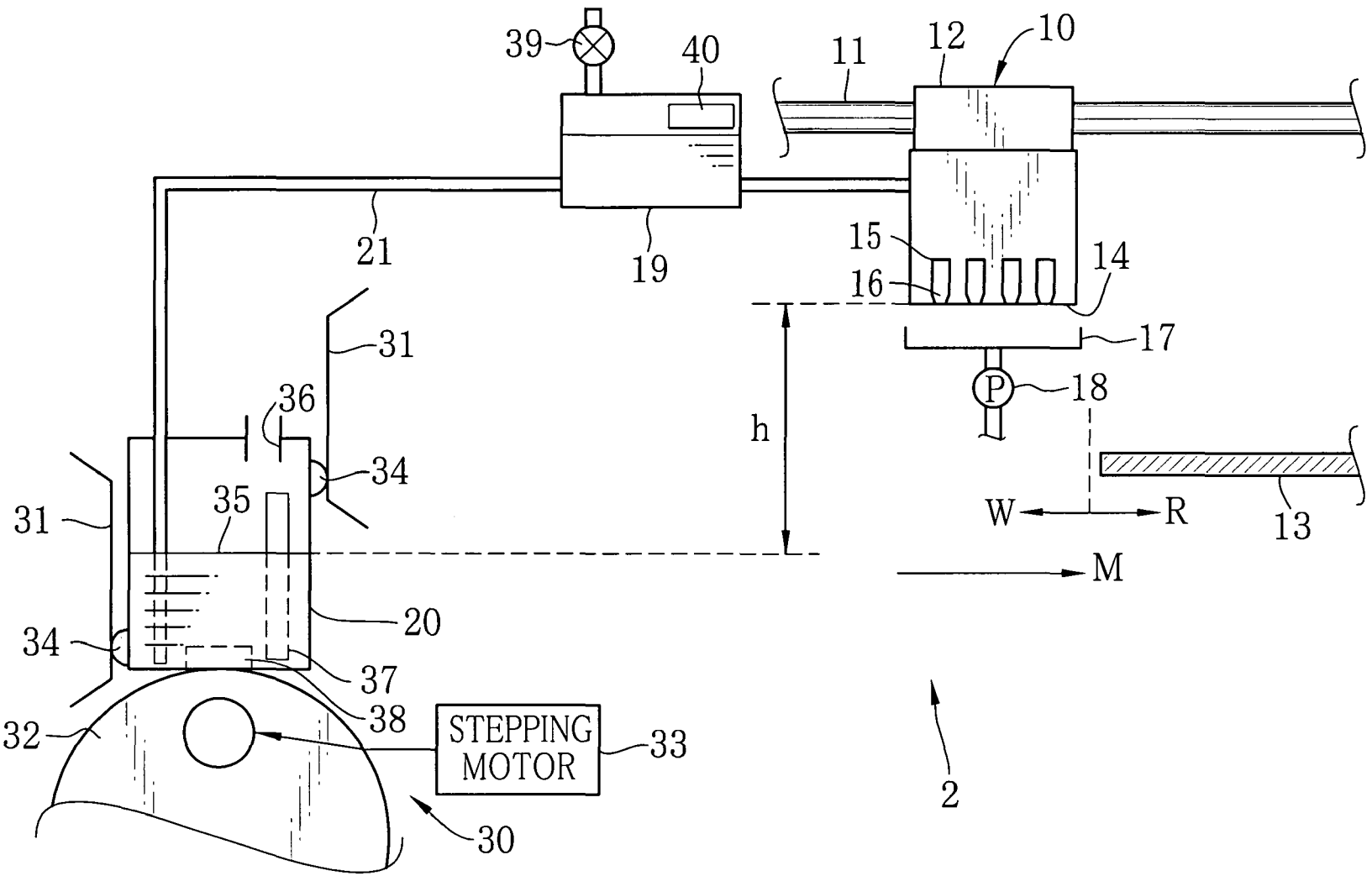
FIG. 1 is an explanatory view in front elevation, illustrating an ink jet printer.

In FIG. 1, an ink jet printer 2 of a preferred embodiment is illustrated. An ink jet printhead 10 of the ink jet printer 2 is supported on a carriage 12. A guide rod 11 extends in a main scan direction M, and is inserted in the carriage 12. The ink jet printhead 10 is caused to move in the main scan direction M back and forth. Feed rollers (not shown) feed recording material or sheet 13 in a sub scan direction S intermittently. See FIG. 2. The ink jet printhead 10 moved with the carriage 12 records an image to the recording material 13 according to ink jet printing.

Figure 2:
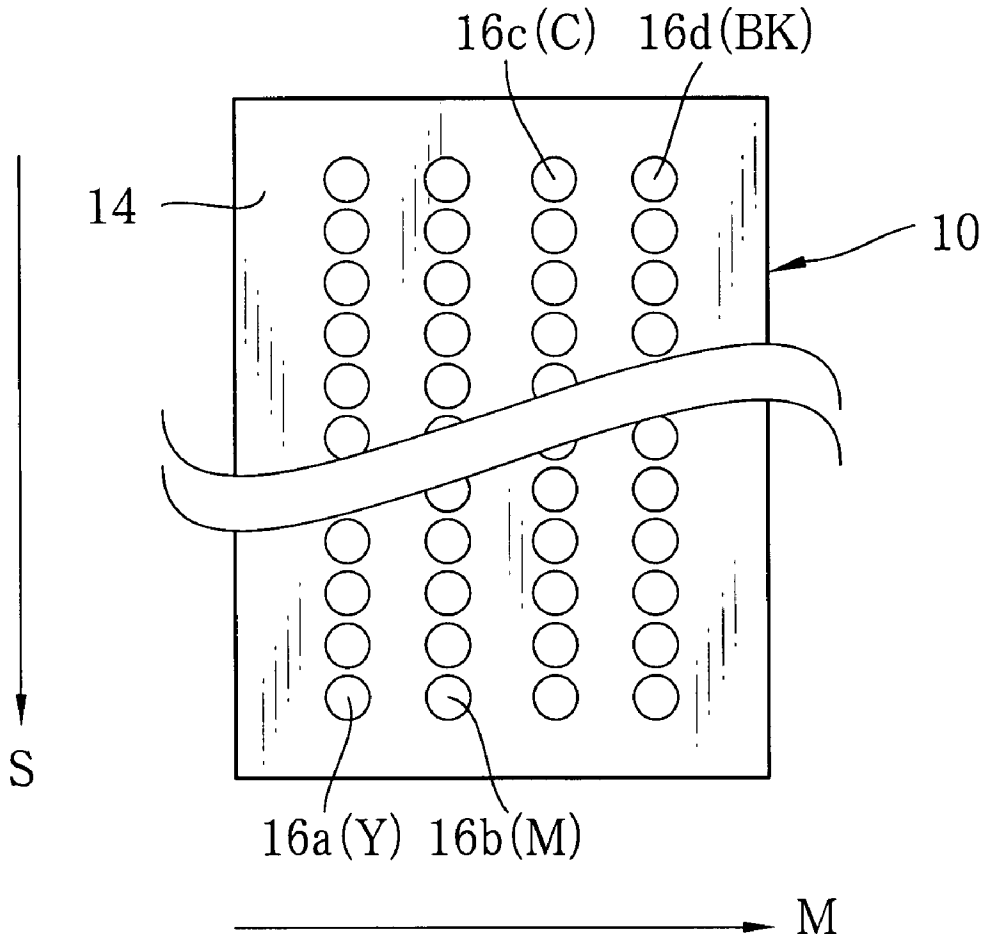
FIG. 2 is a plan illustrating a nozzle arrangement surface of an ink jet printhead.

Ejection nozzles 16 of a plurality of arrays are provided in the ink jet printhead 10, and opposed to the recording material 13 in a nozzle arrangement surface 14. An ink chamber 15 or liquid chamber in the ink jet printhead 10 is connected with the ejection nozzles 16. There are ink ejecting elements at respectively the ejection nozzles 16 for ejecting ink through the ejection nozzles 16 toward the recording material 13. Examples of ink ejecting elements include a piezoelectric element, a heater element according to a bubble jet printing, and the like. The plural arrays of ejection nozzles 16*a*, 16*b*, 16*c* and 16*d* are for four colors which are yellow (Y), magenta (M), cyan (C) and black (BK) colors. In FIG. 2, each array extends in the sub scan direction (S). Note that ink of auxiliary colors may be added, such as dark yellow, light magenta and light cyan.

In FIG. 1, a range of movement of the ink jet printhead 10 is constituted by a printing region R for image recording to the recording material 13 and a standby region W to remain as a margin without image recording. A movable nozzle cap 17 as a suction purge cap mechanism is disposed in the standby region W. The nozzle cap 17 is movable between first and second positions, and when in the first position, tightly contacts the nozzle arrangement surface 14 or is positioned very close to the nozzle arrangement surface 14, and when in the second position, is away from the nozzle arrangement surface 14. The nozzle cap 17 in the first position is caused by suction of a suction pump 18 to withdraw waste part of ink from the ejection nozzles 16.

At the time of printing, a drive signal according to image data for printing is sent to the ink ejecting elements. Thus, ink droplets in a size and amount according to the image data are ejected toward the recording material 13. A full-color image is obtained by the disposition of the ink droplets on the recording material 13.

An ink supply tube or path 21 is used and extends from a reservoir or supply tank 20. A subsidiary tank 19 is supplied with ink from the supply tank 20 by the ink supply tube 21. A pumping height adjustor 30 or tank up-down shifter is associated with the supply tank 20 to shift the supply tank 20 up and down. The pumping height adjustor 30 is constituted by rails 31, an up-down shifting eccentric cam mechanism 32 and an up-down shifting stepping motor 33 as actuator. A guide projection 34 or ridge projects from a lateral face of the supply tank 20, and is engaged with each of the rails 31. The supply tank 20 is moved up and down according to the vertically straight shape of the rails 31. Note that the number of combinations of the subsidiary tank 19, the supply tank 20 and the pumping height adjustor 30 is four because of the four kinds of ink, that are yellow, magenta, cyan and black. An ink cartridge 70 is loaded in the supply tank 20, and is filled with ink used for printing.

The eccentric cam mechanism 32 has a peripheral portion contacting a lower face of the supply tank 20. The stepping motor 33 is actuated to rotate the eccentric cam mechanism 32. The pumping height adjustor 30 shifts the supply tank 20 up and down. An ink surface 35 as liquid surface is provided on the upside of the ink inside the supply tank 20. The pumping height adjustor 30 adjusts the pumping height h defined from the ink surface 35 to the nozzle arrangement surface 14 of the ink jet printhead 10.

For the start of supply of the ink from the supply tank 20 to the ink jet printhead 10, the pumping height adjustor 30 is driven to set the ink surface 35 higher than the nozzle arrangement surface 14. This operation facilitates the supply of the ink, and reduces load of suction of the ink supply pump. It is possible to reduce the size of the pump, and reduce the electric power to be used.

An inlet port 36 is formed in an upper panel of the supply tank 20 for keeping the inside of the supply tank 20 open to the outside. The inlet port 36 keeps the atmospheric pressure applied to the ink surface 35. Also, the inlet port 36 is used for refilling the supply tank 20 with ink. A liquid level sensor 37 is disposed inside the supply tank 20 for detecting a position of the ink surface 35. Specific examples of the liquid level sensor 37 include an electrode type of sensor in which changes in electrical resistance are used, and also include a float switch.

A characteristic information detector 38 is disposed in the supply tank 20 for detecting a characteristic of the ink to be used. When the ink cartridge 70 is replaced with a second one which is unused or a type for a different color, the characteristic information detector 38 reads characteristic information 72 of the ink from the ink cartridge 70. The characteristic information 72 is in a form represented by an outer patterned shape of the ink cartridge 70, or in an optical, electronic or magnetic form recorded as a bar code, IC chip or the like. The characteristic information 72 being read is sent to a system controller 50 by the characteristic information detector 38. See FIG. 3. Examples of the characteristic information 72 of the ink are viscosity, surface tension, density, date of the manufacture, and the like of the ink.

An air release valve 39 is provided on the subsidiary tank 19 for keeping the atomospheric pressure applied to the inside of the subsidiary tank 19. A pressure sensor 40 is disposed in the subsidiary tank 19 for measuring an inner pressure of the ink jet print head 10 and the atmospheric pressure. To measure the atmospheric pressure at the pressure sensor 40, the air release valve 39 is open. To measure the inner pressure of the ink jet printhead 10 at the pressure sensor 40, the air release valve 39 is closed.

The pressure sensor 40 measures the atmospheric pressure while the air release valve 39 is kept open, and also measures inner pressure of the ink jet printhead 10 while the air release valve 39 is kept closed and with the ejection nozzles 16 filled with the ink. A result of the measurement in the pressure sensor 40 is input to the system controller 50 of FIG. 3. The pressure sensor 40 is operated for measuring the inner pressure of the ink jet printhead 10 and the atmospheric pressure. This is at the time of initial operation of the ink jet printer 2, and at each time of lapse of a predetermined time after the start of image recording. Also, the pressure sensor 40 is operated for measuring the inner pressure of the ink jet printhead 10 at each time that a predetermined amount of ink is ejected, or that a predetermined number of ink droplets are ejected. Note that a preferred example of the pressure sensor 40 is a sensor for outputting information of a shift of a diaphragm by conversion into an electric signal with a strain gauge.

Figure 3:
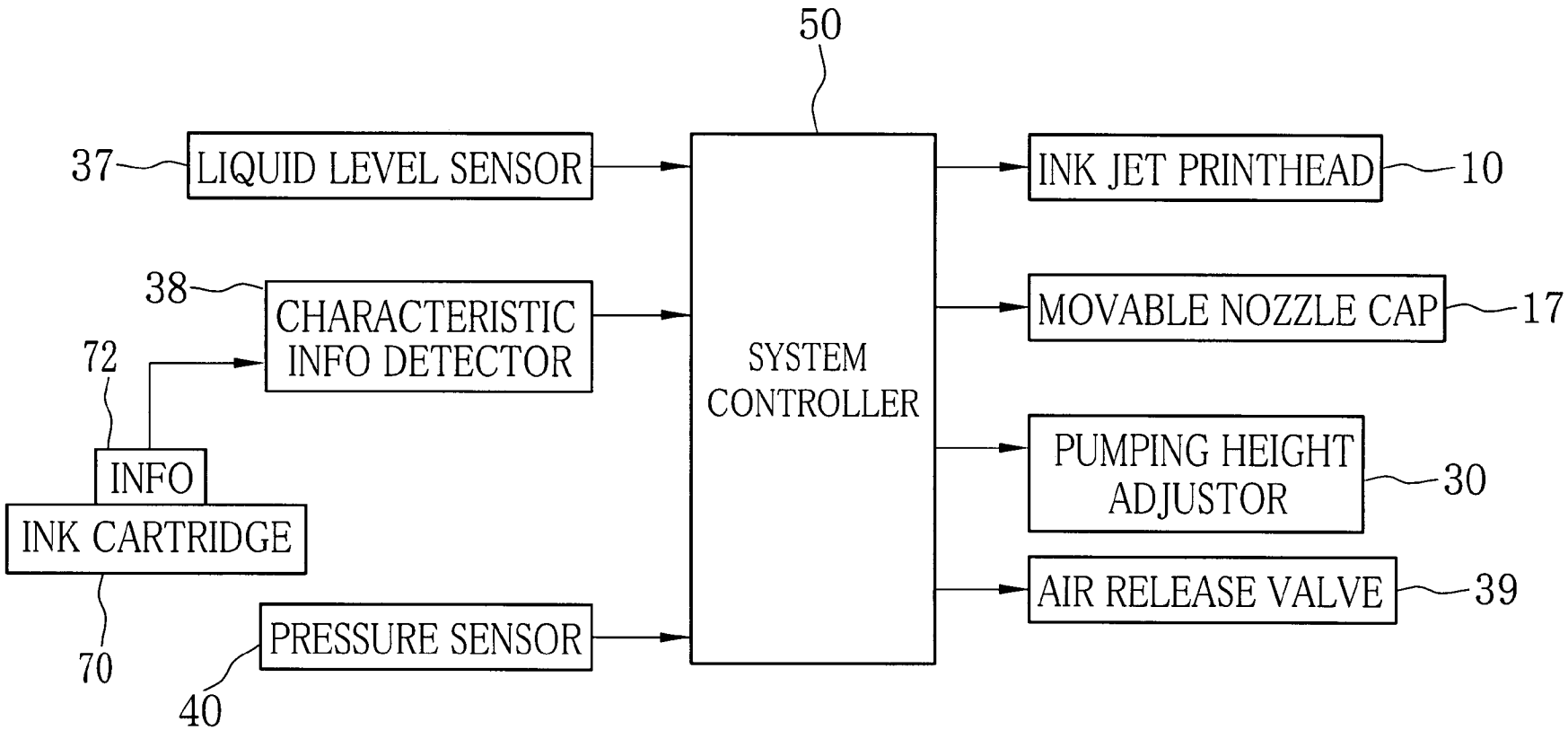
FIG. 3 is a block diagram schematically illustrating relevant circuits in the ink jet printer.

In FIG. 3, electrical circuits in the ink jet printer 2 are illustrated. The system controller 50 controls the entirety of the ink jet printer 2. The system controller 50 receives the detection result from the characteristic information detector 38 and the prescribed characteristic information of the ink jet printhead 10, and according to those, determines a reference value of the pressure difference between the inner pressure of the ink jet printhead 10 and the atmospheric pressure in consideration of optimizing the size of ink droplets to be ejected. An example of the reference value is in a range from −200 mmHg to −40 mmHg. According to the art of the ink jet printhead, the inner pressure is determined smaller than the atmospheric pressure.

The system controller 50 receives the detection result from the pressure sensor 40, and subtracts the atmospheric pressure from the inner pressure of the ink jet printhead 10, to determine a pressure difference. The pumping height adjustor 30 is controlled to set the pressure difference equal to a reference value. The liquid level sensor 37 detects a position of the ink surface 35, to adjust a pumping height h.

Figure 4:
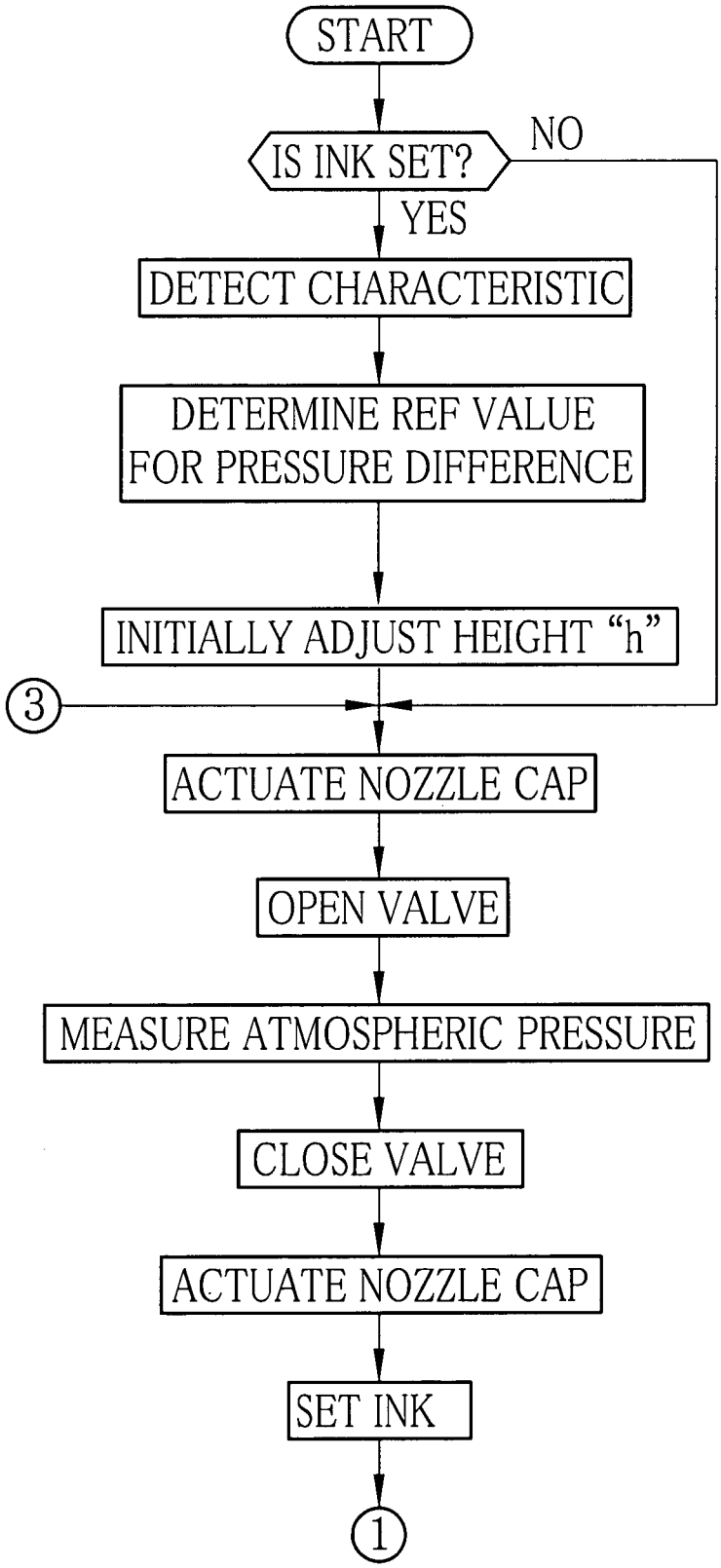
FIG. 4 is a flow chart illustrating a starting portion of an image recording process.
Figure 5:
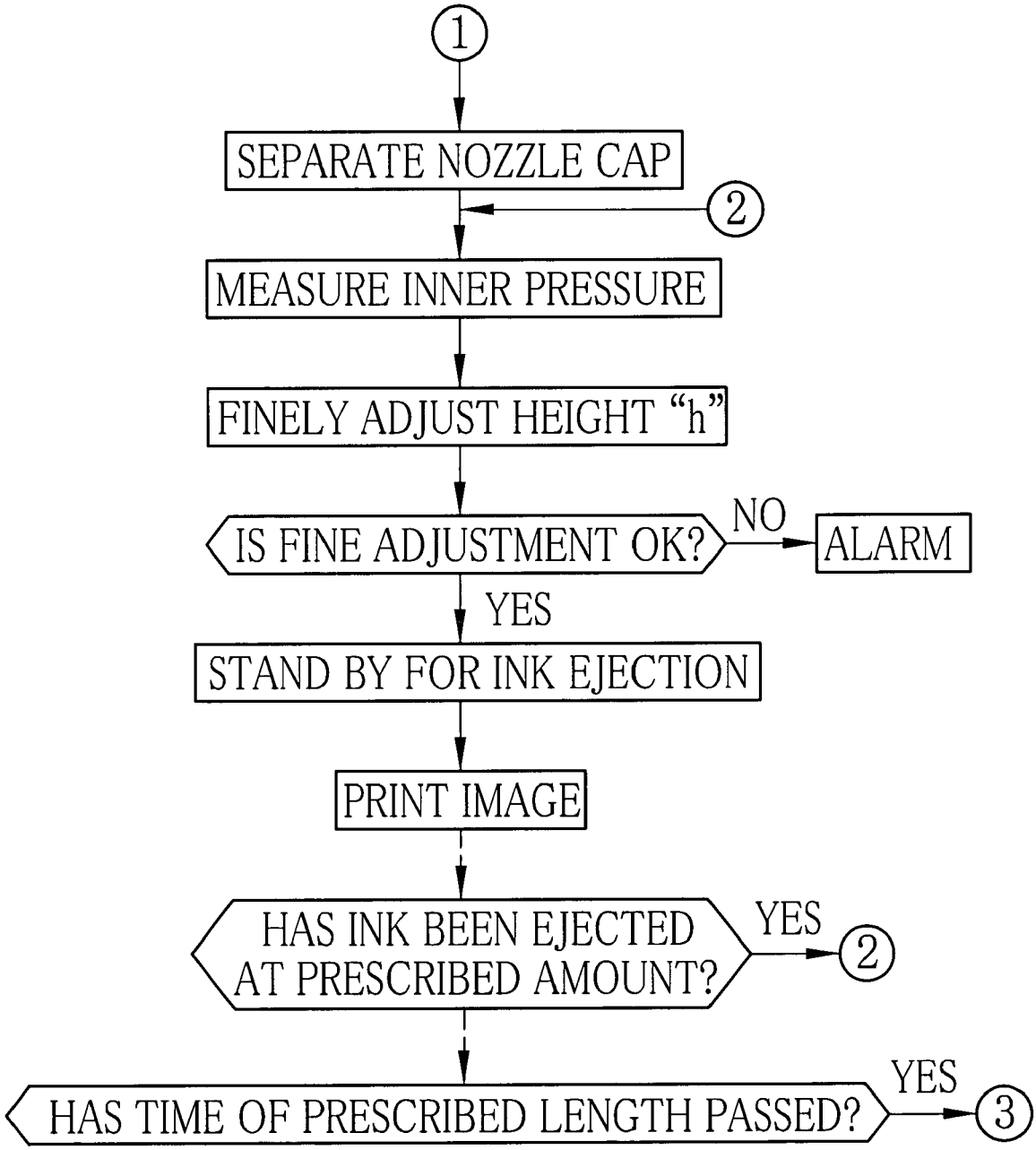
FIG. 5 is a flow chart illustrating an ending portion of an image recording process.

The operation of the embodiment is described now with reference to FIGS. 4 and 5. At first, supply of power to the ink jet printer 2 is turned on. If the ink cartridge 70 being unused is set in the supply tank 20, the characteristic information detector 38 reads the characteristic information 72 of the characteristic of the ink. A result of reading is sent from the characteristic information detector 38 to the system controller 50.

According to the characteristic information 72 of the ink and characteristic information of the ink jet printhead 10, the system controller 50 effects calculation to determine a reference value for the pressure difference between the inner pressure and the atmospheric pressure. The pumping height adjustor 30 is driven and controlled by the system controller 50 to set the pressure difference equal to the reference value, so that the pumping height h is initially adjusted. Note that, if there is no change in the ink cartridge 70, no initial adjustment of the pumping height h is effected.

After the initial adjustment of the pumping height h, the nozzle cap 17 is shifted and contacts the nozzle arrangement surface 14 tightly for the purpose of preventing leakage of the ink from the ejection nozzles 16. Otherwise, the nozzle cap 17 is shifted to a position opposed to the nozzle arrangement surface 14 for receiving leaked part of the ink. After this, the air release valve 39 is opened to apply the atmospheric pressure to the inside of the subsidiary tank 19. In this state, the pressure sensor 40 measures the atmospheric pressure. Note that it is possible to dispose the nozzle cap 17 in a stationary manner. The nozzle cap 17 may be fixed in the region W, because the ink jet printhead 10 can be moved into and out of the region W.

After the atmospheric pressure is measured, the air release valve 39 is closed. The nozzle cap 17 comes to contact the nozzle arrangement surface 14 tightly, to suck ink from the ejection nozzles 16. Then the ejection nozzles 16 are filled with ink from the subsidiary tank 19, before the nozzle cap 17 comes away from the nozzle arrangement surface 14. In this state, the pressure sensor 40 measures the inner pressure of the ink jet printhead 10.

According to the results of the measurement of the pressure sensor 40, the system controller 50 determines the pressure difference by subtracting the atmospheric pressure from the inner pressure of the ink jet printhead 10. The output of the stepping motor 33 is changed at a small amount by checking the position of the ink surface 35 at the liquid level sensor 37. The pressure difference is monitored, so that the pumping height h is finely adjusted so as to set the pressure difference equal to the reference value. In a manner similar to the initial adjustment of the pumping height h, the nozzle cap 17 is shifted to a position opposed to the nozzle arrangement surface 14 for receiving leaked part of the ink.

At the time of this fine adjustment, it is likely that an abrupt change in the pressure is detected by the pressure sensor 40. Then it is judged that leakage of the ink from the ink jet printhead 10 has occurred, or air has leaked into the ejection nozzles 16. If the fine adjustment of the pumping height h is not completed at the lapse of a predetermined time, then occurrence of shortage of the ink is determined. An alarm signal is generated to inform an operator of the alarm state.

After the fine adjustment of the pumping height h, the ink jet printer 2 stands by for printing. A command signal for starting printing is input. The ink jet printhead 10 is moved in the main scan direction M back and forth. While the recording material 13 is fed in the sub scan direction S, an image is recorded by the ink jet print head 10 to the recording material 13. During the image recording, the pressure sensor 40 measures the inner pressure of the ink jet printhead 10 at each time that a prescribed amount of ink is ejected through the ejection nozzles 16. A pressure difference is obtained according to the inner pressure in combination with the atmospheric pressure having been measured. The pumping height h is adjusted to set the pressure difference at the reference value.

According to the construction above, it is possible to print an image with ink droplets of a regularly optimized size. Also, it is possible to print an image at a high quality even to PPC (plain paper copier) paper, regenerated paper or other recording material in which bleeding of ink is likely to occur.

In the above embodiment, changes in the pressure difference are detected at each time of ejection of a predetermined amount of ink droplets in the course of the image recording to adjust the pumping height h. However, the height may be adjusted at each time of recording one image, or at each time of recording a predetermined number of images. Also, changes in the pressure difference may be adjusted at each time of recording a predetermined number of lines, or upon each lapse of time of a predetermined length in the image recording.

Figure 6:
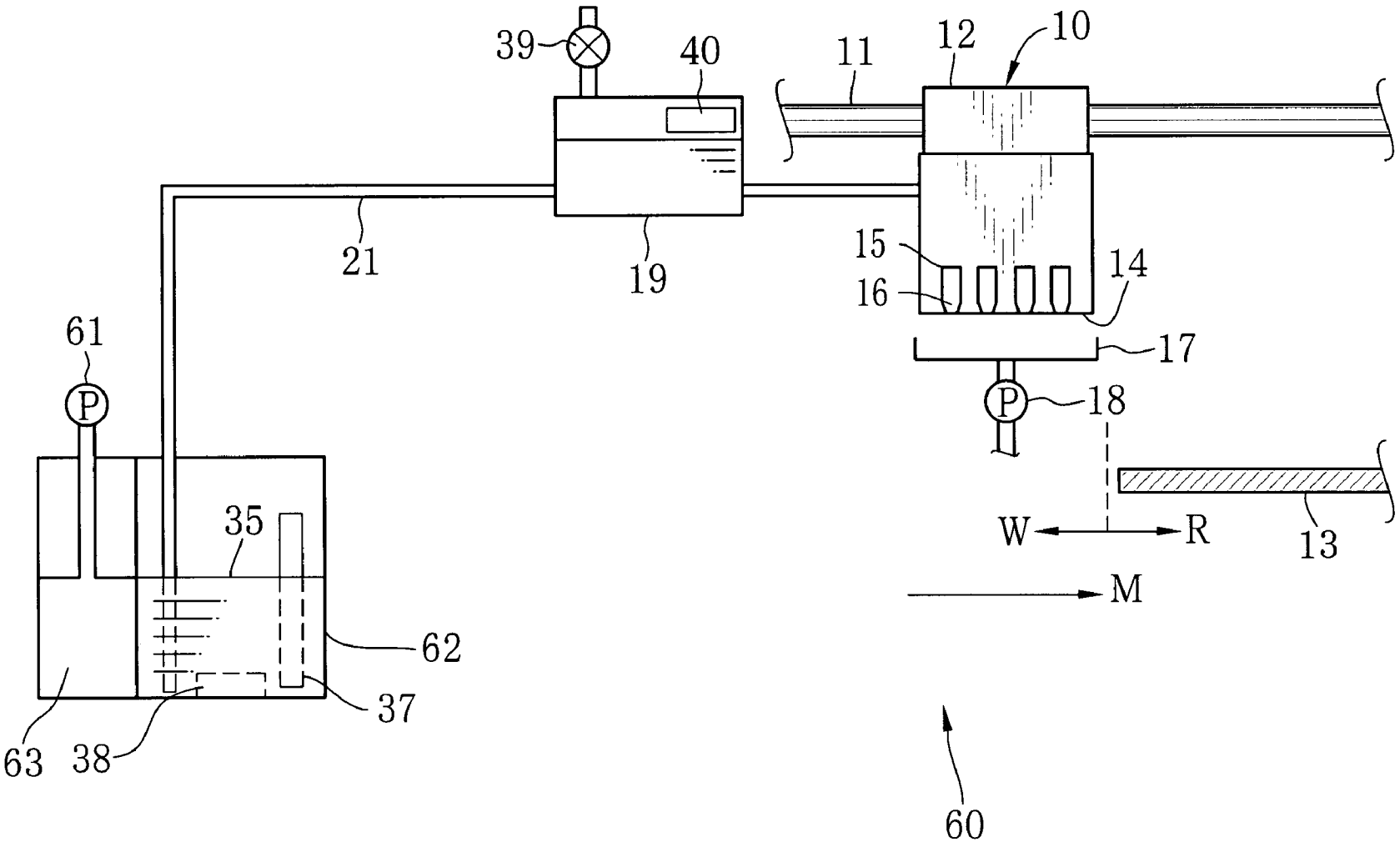
FIG. 6 is an explanatory view in front elevation, illustrating another preferred ink jet printer.

In FIG. 6, another preferred ink jet printer 60 of the invention is illustrated. Instead of the pumping height adjustor 30 of the above embodiment, a pressure adjusting air pump 61 as pressure adjustor is included in the ink jet printer 60 for adjusting a pressure difference between the inner pressure of the ink jet printhead 10 and the atmospheric pressure. A reservoir or supply tank 62 is a tightly enclosed container of a flexible form, and stores ink.

The pressure adjusting air pump 61 is connected with a flexible air container 63, which is disposed to contact a lateral side of the supply tank 62. The pressure adjusting air pump 61 sends air to, and sucks air from the air container 63, to change pressure of supply of the ink to the subsidiary tank 19. It is possible to dispose a pressure adjusting valve in the ink supply tube 21 for suction with a pump, so as to generate pressure to compensate for changes in the water head pressure due to a change in the ink type, replenishment of ink, or other reasons.

In the first embodiment, the reference value of the pressure difference between the inner pressure and the atmospheric pressure is determined in consideration of the characteristic of the ink and specifics of the ink jet printhead 10, for the purpose of adjusting the pumping height h. However, it is possible to adjust the pumping height h in consideration of quality of images to be recorded. For example, a high quality mode and a normal mode may be predetermined. When the high quality mode is set, the pumping height h can be determined high to decrease a size of ink droplets. When the normal mode is set, the pumping height h can be determined low to increase a size of ink droplets.

In the above embodiment, the ink jet printhead 10 and the supply tank 20 are so disposed as to set the ink surface 35 in the supply tank 20 in parallel with the nozzle arrangement surface 14 of the ink jet printhead 10. Furthermore, the novel feature of the invention is effective even for a structure of the ink jet printhead 10 being oriented vertically or with an inclination. However, additional pressure is applied to the low disposed nozzles of the ink jet printhead 10 further than the high disposed nozzles. It is likely that air will flow into the high disposed nozzles, and that ink will leak from out of the low disposed nozzles. Consequently, it is necessary to set small the reference value for the pressure difference between the atmospheric pressure and the inner pressure of the ink jet printhead 10.

It is to be noted that the pumping height adjustor 30 may have a structure other than the above. For example, a structure for moving a lower face or lateral face of the supply tank 20 may be moved to change a position of the ink surface 35. Furthermore, it is possible to move the ink jet printhead 10 and the recording material 13 vertically instead of moving the supply tank 20. Also, the movement of the ink jet printhead 10 and the recording material 13 may be combined with the movement of the supply tank 20. If a change in the pumping height h is sufficiently small in consideration of the surface tension of the ink meniscus at the ejection nozzles 16, the pumping height h may be adjusted for one time without separation between the colors. Note that the pumping height adjustor 30 is basically constituted by the eccentric cam mechanism 32. However, a structure for shifting up and down the supply tank 20 may be constituted by a rack/pinion mechanism, a linking mechanism and other suitable mechanisms known in the art.

In the above embodiment, the air release valve 39 is provided on the subsidiary tank 19. The pressure sensor 40 is single for the purpose of measuring the inner pressure and the atmospheric pressure. However, the air release valve 39 may be omitted. The subsidiary tank 19 may have a tightly enclosed structure. It is possible to use a separate pressure sensor for measuring the atmospheric pressure. In such a construction, there is no opening or closing operation of the air release valve 39. There is no control of actuating and separating the nozzle cap 17. Furthermore, the pressure sensor may be disposed in a common liquid chamber in side the ink jet print head 10. However, this necessitates consideration of a position of disposing the pressure sensor not to influence the ejection of the ink.

Also, it is possible to use a selectable construction in which an operator can determine the time of detecting the pressure difference between the inner pressure of the ink jet printhead 10 and the atmospheric pressure. Furthermore, it is possible to detect an amount of the remainder of the ink according to the pressure difference between the inner pressure of the ink jet printhead 10 and the atmospheric pressure.

Figure 7:
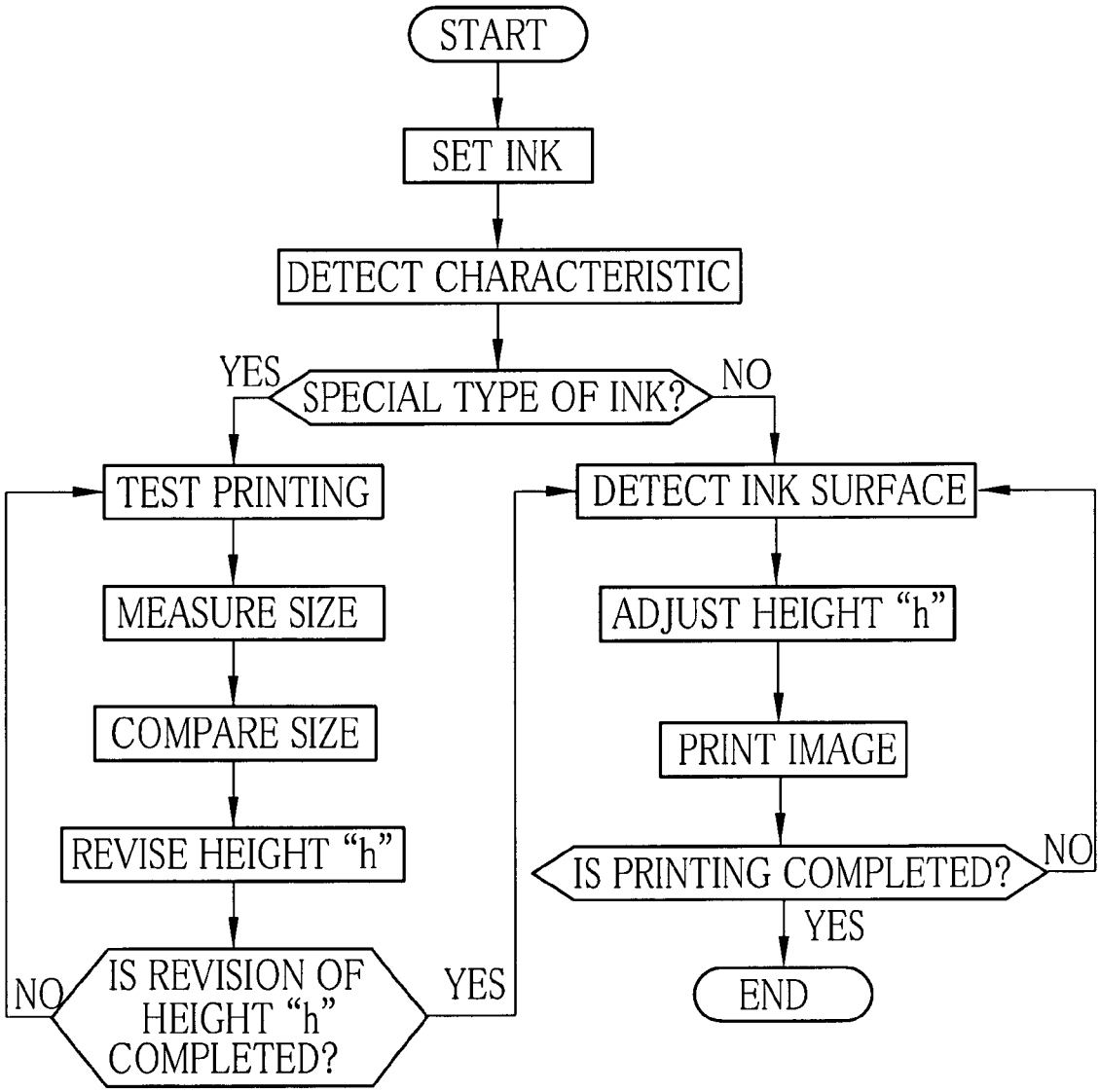
FIG. 7 is a flow chart illustrating an image recording process of one preferred embodiment.

In FIG. 7, another preferred process of the image recording in the ink jet printer 2 is illustrated. At first, the characteristic information 72 is read by the characteristic information detector 38 from the ink cartridge 70 set in the supply tank 20. The characteristic information 72 is sent to the system controller 50.

According to the characteristic information 72 of the ink, it is checked whether the ink is a special type or a general-purpose type. The special type is one of types of gold, silver and metal. In the case of the general-purpose type, the liquid level sensor 37 detects the position of the ink surface 35. The pumping height h is adjusted by driving the pumping height adjustor 30. An image is recorded by use of ink droplets in an optimized size.

In the case of the special type, the ink jet printer 2 is tested in the step of test printing. A test print is produced, to measure the size of ink droplets ejected to the recording material 13. For the purpose of the size measurement, a CCD camera picks up an image of the test print. The size is obtained according to a known technique of extracting the contour.

Then the optimized size of ink droplets is compared with the measured size of ink droplets. According to a result of the comparison, the pumping height h is revised. The pumping height adjustor 30 is so driven that, if the measured size is greater, the pumping height his set greater, and if the measured size is smaller, the pumping height h is set smaller. After the revising operation, an image is recorded in adjusting the pumping height h in a similar manner to the use of the ordinary ink.

In the above embodiments, the ink jet printer is a serial printer. However, an ink jet printer of the invention may be a line printer in which a print head extends in a main scan direction, and recording material is moved in a sub scan direction. Also, the liquid ejected according to the invention may be other than the ink.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A liquid ejecting device comprising:

a liquid ejecting head, including an array of plural ejection nozzles for ejecting liquid at an ejecting amount controlled individually from one another;

a supply tank, loaded with said liquid, for supplying said liquid ejecting head with said liquid;

at least one pressure sensor for measuring atmospheric pressure and inner pressure of said liquid ejecting head;

a controller for setting a pressure difference between said atmospheric pressure and said inner pressure at a predetermined value by adjustment; and a characteristic information detector for detecting characteristic information of said liquid, wherein said predetermined value is a reference value for regularizing said ejecting amount, and wherein said controller determines said reference value according to said characteristic information.

2. A liquid ejecting device as defined in claim 1, wherein said pressure sensor is disposed on said liquid ejecting head, or a liquid supply path for connection between said liquid ejecting head and said supply tank.

3. A liquid ejecting device as defined in claim 2, further comprising:

a subsidiary tank, connected between said supply tank and said liquid ejecting head, for storing said liquid in a temporary manner;

an air release valve for causing application of said atmospheric pressure to an inside of said subsidiary tank;

wherein said pressure sensor is disposed in said subsidiary tank, and when said air release valve is open, detects said atmospheric pressure, and when said air release valve is closed, detects said inner pressure.

4. A liquid ejecting device as defined in claim 2, further comprising a pumping height adjustor for shifting up or down one of said liquid ejecting head and said supply tank relative to a remaining one thereof, to change a pumping height obtained by subtracting a height level of a liquid surface of said liquid in said supply tank from a height level of a nozzle arrangement surface of said plural ejection nozzles.

5. A liquid ejecting device as defined in claim 4, further comprising a liquid level sensor, disposed in said supply tank, for detecting a position of said liquid surface;

wherein said pumping height adjustor obtains said height level of said liquid surface according to said position thereof, and moves said supply tank.

6. A liquid ejecting device as defined in claim 5, wherein when supply of said liquid from said supply tank is initially started, said pumping height adjustor sets said liquid surface higher than said nozzle arrangement surface, to promote supply to said liquid ejecting head.

7. A liquid ejecting device as defined in claim 6, wherein said pumping height adjustor includes:

a tank up-down shifter for moving said supply tank up and down; and at least one rail for guiding said supply tank up and down by preventing said supply tank from offsetting horizontally.

8. A liquid ejecting device as defined in claim 2, further comprising a pressure adjustor, controlled by said controller, for adjusting a liquid pressure for supply of said liquid from said supply tank according to said pressure difference.

9. A liquid ejecting device as defined in claim 8, wherein at least one portion of said supply tank is constituted by a flexible panel;

said pressure adjustor further includes:

a flexible air container secured to an outside of said flexible panel; and an air pump for supplying air into, or exhausting air from, said air container, to increase or decrease said liquid pressure in said supply tank through said flexible panel.

10. A liquid ejecting device as defined in claim 9, further comprising an inlet port, formed through said supply tank, settable between open and closed states, adapted for replenishment of said liquid when set in said open state, wherein said atmospheric pressure is applied to said liquid surface through said inlet port.

11. A liquid ejecting device as defined in claim 2, further comprising a nozzle cap mechanism, movable to and away from said liquid ejecting head, actuated while said pressure sensor measures said atmospheric pressure, for covering said ejection nozzles, to prevent said liquid from leakage.

12. A liquid ejecting device as defined in claim 11, wherein while said nozzle cap mechanism is away from said ejection nozzles, said pressure sensor measures said inner pressure.

13. A liquid ejecting device as defined in claim 2, wherein said supply tank is loaded with a liquid cartridge for containing said liquid;

said characteristic information is disposed on a surface of said liquid cartridge, and read by said characteristic information detector.

14. A liquid ejecting device as defined in claim 13, wherein said characteristic information detector reads said characteristic information in response to loading of said liquid cartridge.

15. A liquid ejecting device as defined in claim 13, wherein said controller determines an initial level of said reference value in response to loading of said liquid cartridge.

16. A liquid ejecting device as defined in claim 13, wherein said pressure sensor measures said inner pressure and said atmospheric pressure in response to loading of said liquid cartridge.

17. A liquid ejecting device as defined in claim 2, wherein said pressure sensor measures said inner pressure and said atmospheric pressure each time upon lapse of a predetermined time.

18. A liquid ejecting device as defined in claim 2, wherein if said inner pressure measured by said pressure sensor changes during determination of said ejecting amount in said controller, said controller generates an alarm signal.

19. A liquid ejecting device as defined in claim 2, wherein said pressure sensor measures said inner pressure each time that said liquid ejecting head ejects said liquid at a predetermined amount.

20. A liquid ejecting device as defined in claim 2, wherein said characteristic information is information of at least one of viscosity, surface tension, density and producing date of said liquid.

21. A liquid ejecting device as defined in claim 2, wherein said liquid is one of at least first and second types, and said characteristic information represents said first or second type.

22. A liquid ejecting device as defined in claim 2, wherein a nozzle arrangement surface of said plural ejection nozzles is kept oriented substantially horizontally.

* * * * *